US006255565B1

(12) United States Patent
Tamura

(10) Patent No.: US 6,255,565 B1
(45) Date of Patent: Jul. 3, 2001

(54) ELECTRIC STRINGED MUSICAL INSTRUMENT HAVING STRETCHABLE FRAME BODY

(75) Inventor: Shinya Tamura, Shizuoka (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/516,530

(22) Filed: Mar. 1, 2000

(30) Foreign Application Priority Data

Mar. 3, 1999 (JP) ..... 11-055431

(51) Int. Cl.[7] ..... G10D 1/02
(52) U.S. Cl. ..... 84/275; 84/290
(58) Field of Search ..... 84/274, 275, 290, 84/291

(56) References Cited

U.S. PATENT DOCUMENTS

D. 249,387 * 9/1978 Hart .
D. 395,912 * 7/1998 Schaub .
4,646,613 * 3/1987 Banchetti .
4,686,882 * 8/1987 Shaw ..... 84/291
4,770,079 * 9/1988 Mastroianni ..... 84/291
5,058,479 * 10/1991 Shaw ..... 84/291
5,654,514 * 8/1997 Tracey .
5,990,397 * 11/1999 Taylor ..... 84/291 X

FOREIGN PATENT DOCUMENTS 4336002 4/1995 (DE) .

* cited by examiner

*Primary Examiner*—Jeffrey Donels
(74) *Attorney, Agent, or Firm*—Ostrolenk, Faber, Gerb & Soffen, LLP

(57) ABSTRACT

An electric cello has a frame body, a stretchable frame of which is changed between a stretched position spread from a trunk and a shrunk position in close proximity of the trunk so that a cellist easily carries the electric cello in his arms.

10 Claims, 7 Drawing Sheets

ELECTRIC STRINGED MUSICAL INSTRUMENT HAVING STRETCHABLE FRAME BODY

FIELD OF THE INVENTION

This invention relates to an electric stringed musical instrument and, more particularly, to an electric stringed musical instrument having a frame body to be held by a player.

DESCRIPTION OF THE RELATED ART

An acoustic bowed stringed musical instrument is broken down into a body, a bridge, pegs, a neck and strings. The bridge is attached to the body, and the neck projects from the body. The pegs are attached to the leading end portion of the neck, and the strings are stretched between the bridge and the pegs. A resonator is formed in the body, and the acoustic bowed stringed musical instrument generates loud tones through the resonator.

The violin family is categorized into the bowed stringed musical instrument, and has members called as a double-bass, a cello, a viola and a violin. The violin and the double-bass have the highest compass and the lowest compass, respectively, and the viola and cello are between the violin and the double-bass. The compass is dependent on the length and the thickness of the strings. The lower the compass, the larger the resonator. For this reason, the members of the violin family have the bodies and the necks different in size and length from one another. For example, the cello has the total length four times greater than the total length of the violin. A typical cello is 120 centimeters long.

The loudness is different between the members of the violin family. The cello generates the tones twice larger in loudness than the tones generated by the violin. Especially, the amplitude of the lower-pitched part is so wide that a metal mute can not reduce the loudness of cello's tones. For this reason, the players can not practice the cello anytime anywhere. Although the cello is a favorite musical instrument, the players are not so many as the persons who want to learn the cello.

An electric cello is proposed. The electric cello has a body, a neck and strings as similar to the acoustic cello. However, any resonator is not formed in the body. Instead, a pick-up is provided under the strings, and cello-like sounds are electronically generated through a digital signal processing.

FIG. 1 shows the prior art electric cello. The prior art electric cello is designated by reference numeral 1. The prior art electric cello 1 has a trunk 2, a rigid frame 3 and a neck 4. The trunk 2 is integral with the neck 4, and the combination of the trunk 2 and the rigid frame 3 are corresponding to the body of the acoustic cello. The neck 4 projects from the rigid frame 3, and a peg box 5 is attached to the leading end of the neck 4. Pegs 6 are screwed into the peg box 5, and a string holder 7 is attached to the trunk 2 at the other end portion. Each string 8 is fixed at one end thereof to the string holder 7, and the other ends of the strings 8 are wound on the pegs 6. Thus, the strings 8 are stretched between the pegs 6 and the string holder 7. A bridge 9 is attached to the trunk 2 between the neck 4 and the string holder 7, and gives tension to the strings 8. An end pin 10 is attached to the trunk 2, and projects in the direction opposite to the neck 4.

The rigid frame 3 is asymmetry with respect to the trunk 2. The rigid frame 3 is broken down into a lower frame 3*a* and an upper frame 3*b*. Although the lower frame 3*a* symmetrically projects toward both sides of the trunk 2, the upper frame 3*b* projects toward the left side of the trunk 2. Thus, the upper frame 3*b* makes the rigid frame 3 asymmetry with respect to the trunk 2. The rigid frame 3 is rigid, and does not change the configuration. As described hereinbefore, the prior art electric cello 1 does not require any resonator, and the rigid frame 3 is thinner than the body of the acoustic cello. The thin rigid frame 3 makes the prior art electric cello light, and enhances the portability of the prior art electric cello.

Though not shown in FIG. 1, a pick-up is embedded in the bridge 9, and converts vibrations of the strings 8 to an analog electric signal. The pick-up forms a part of an electronic sound generating system, and a digital equalizer is further incorporated in the electronic sound generating system. The analog electric signal is transferred to the digital equalizer (not shown), and the digital equalizer produces an audio signal representative of electronic cello tones from the analog electric signal. Namely, the digital equalizer gives a suitable envelope to the oscillating signals, and imparts a kind of reverberation generated in a concert hall to the electronic cello tones. The electronic sound generating system further controls the loudness of the electronic cello tones. The electronic sound generating system reduces the loudness of the electronic cello tones to a tenth of that of the acoustic cello tones. The sound energy of the electronic cello tone is of the order of a hundredth of that of the acoustic cello tones, i.e., −20 dB on the average between the four strings. When the electronic sound generating system minimizes the loudness, the electronic cello tones are as faint as whispers, and a player can practice the prior art electric cello without nuisance to the neighborhood.

A cellist plays the prior art electric cello in a similar manner to the acoustic cello. The cellist sits down on a chair, and stands the end pin 10 on the floor. The cellist inclines the prior art electric cello toward his left shoulder. The neck 4 rests on the left shoulder, and the rigid frame 3 may be held in contact with his chest. The cellist sandwiches the lower frame 3*a* between his knees. Then, the cellist starts to bow the prior art electric cello. If the cellist loosens the knees, the prior art electric cello becomes unstable, and the bowing gives rise to turn around the end pin 10. When the cellist imparts vibrato, the left had can not hold the neck 4, and the prior art electric cello loses the stability. Thus, the cellist requires the lower frame 3*a* as wide as the body of the acoustic cello.

Although the rigid frame 3 is thinner than the body of the acoustic cello, the rigid frame 3 is as wide as the body of the acoustic cello, and the prior art electric cello 1 is equal in height to the acoustic cello. For this reason, the prior art electric cello is less portable, and a cellist feels the prior art electric cello bulky to carry about.

Another prior art electric cello is disclosed in German Patent Application laid-open DE 4336002A1. Any retainer to be sandwiched between the knees of a player is not attached to the prior art electric cello disclosed in the laid-open, and the cellist encounters a problem in the unstable attitude during the performance.

SUMMARY OF THE INVENTION

It is therefore an important object of the present invention to provide an electric cello, which is portable without sacrifice of stability during a performance.

To accomplish the object, the present invention proposes to employ a stretchable frame body in an electric stringed musical instrument.

In accordance with one aspect of the present invention, there is provided a n electric stringed musical instrument comprising a frame body including a stretchable frame changed between a shrunk position in proximity to a center line thereof and a stretched position spread from the center line, at least one string stretched over the frame body along the center line and a sound generating system converting vibrations of the at least one string to an electric sound.

BRIEF DESCRIPTION OF THE DRAWINGS

The features and advantages of the electric stringed musical instrument will be more clearly understood from the following description taken in conjunction with the accompanying drawings in which.

DESCRIPTION OF THE PREFERRED EMBODIMENT

Figure 1:
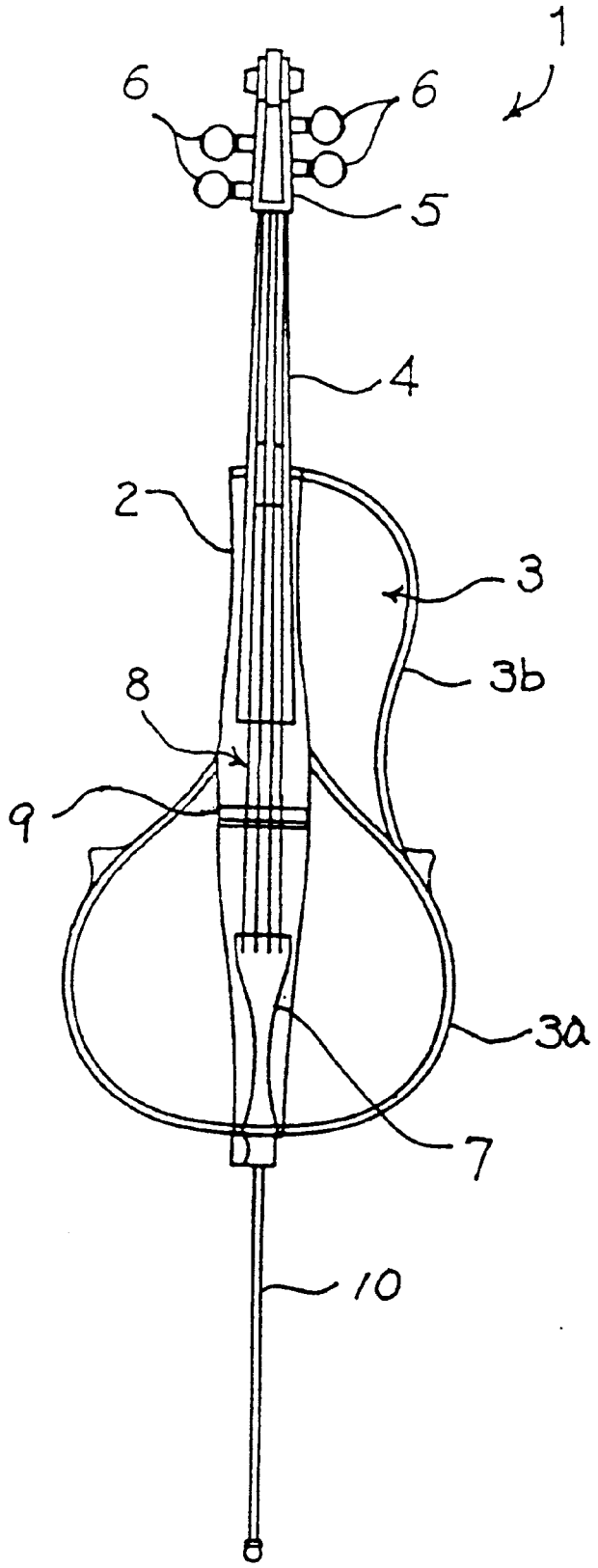
Fig. 1 PRIOR ART
FIG. 1 is a front view showing the structure of the prior art electric cello.
Figure 2:
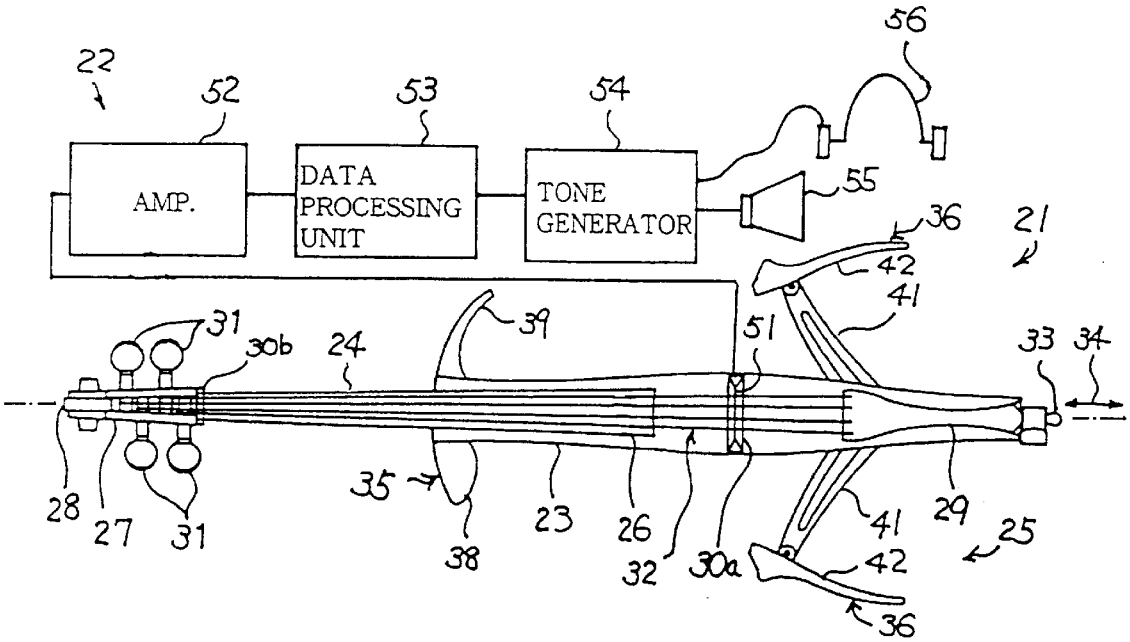
FIG. 2 is a front view showing the structure of an electric cello according to the present invention.
Figure 3:
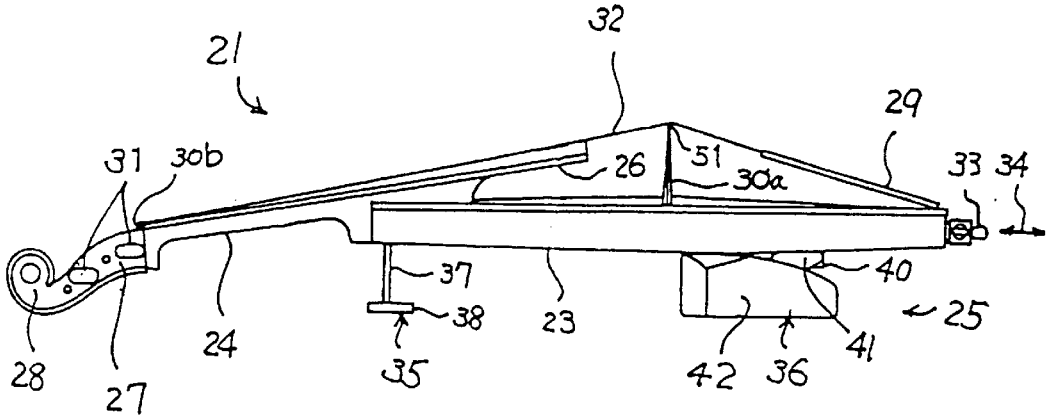
FIG. 3 is a side view showing the structure of the electric cello according to the present invention.
Figure 4:
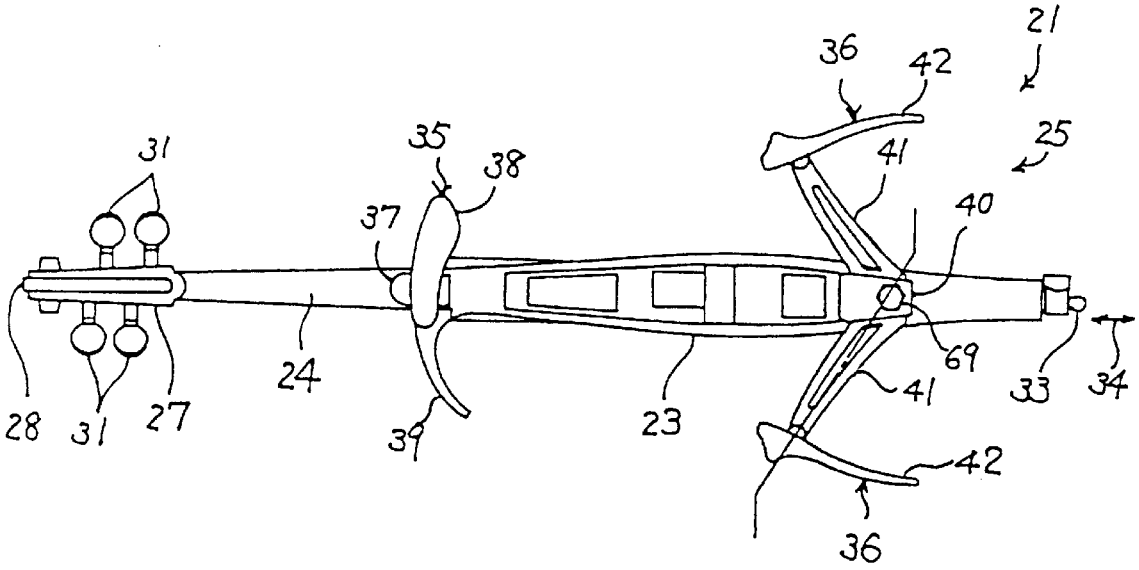
FIG. 4 is a rear view showing the electric cello equipped with a stretchable frame body.

Referring to FIGS. 2, 3 and 4 of the drawings, an electric cello embodying the present invention largely comprises a cello 21 and an electronic sound generating system 22. While a cellist is bowing the cello 21, the electronic sound generating system 22 generates electronic cello tones.

The cello 21 includes a trunk 23, a neck 24 projecting from the trunk 23 and a stretchable frame body 25 attached to the trunk 23. A center line of the trunk 23 is indicated by a dot-and-dash line. The trunk 23 gently bulges around an intermediate portion thereof, and the neck 24 is attached to one end portion of the trunk 23, and inclines toward the back side of the trunk 23. A finger board 26 is attached to the neck 24. In the following description, term "longitudinal" is used to modify a direction in which the trunk 23 is elongated, and term "lateral" is indicative of the perpendicular direction to the longitudinal direction.

A peg box 27 is fixed to the leading end of the neck 24, and a scroll 28 is attached to the peg box 27. A tail piece 29 is connected at one end thereof to the trunk 23, and a bridge 30*a* is upright at the intermediate portion of the trunk 23. Another bridge 30*b* is fixed to the leading end of the finger board 26. Pegs 31 are turnably supported by the peg box 27. Four strings 32 are anchored to the tail piece 29, and are wound on the pegs 31, respectively. Thus, the strings 32 are stretched over the finger board 26 and the trunk 23, and are held in contact with the bridges 30*a* and 30*b*. An end pin 33 is accommodated in the trunk 23, and is projectable from the trunk 23 as indicated by arrow 34.

The stretchable frame body 25 is corresponding to the body of an acoustic cello, and has a resting frame 35 and a stretchable frame 36. The resting frame 35 is fixed to the back surface of the trunk 23, and laterally extends. The resting frame 35 has a stem 37, a pad 38 and a handle 39. The stem 37 projects from the back surface of the trunk 23, and the pad 38 is attached to the leading end of the stem 37. The stem 37 keeps the pad 38 spaced from the trunk 23, and the pad 38 rests on the chest of a cellist during the bowing. On the other hand, the handle 39 is laterally projects from the side surface of the trunk 23, and a cellist grips the handle 39 in order to move and support the electric cello 21.

The neck 24, the finger board 26, the peg box 27, the scroll 28, the tail piece 29, the bridges 30*a*/ 30*b*, the pegs 31, the strings 32 and the end pin 33 are similar to those of an acoustic cello, and the parts of the acoustic cello are available for the electric cello.

The stretchable frame 36 is attached to the back surface of the trunk 23. As will be better seen in FIG. 4, a connector 40 is attached to the back surface of the trunk 23. Arms 41 are rotatably connected at the boss portions thereof to the connector 40, and project toward both sides of the trunk 23. Pads 42 are connected to the leading ends of the arms 41, respectively, and the angles between the arms 41 and the pads 42 are varied depending upon the attitude of the pair of stretchable frames 36. The pads 42 have outer side surfaces curved like corresponding parts of the body of an acoustic cello or the lower frame 3*a* of the prior art electric cello. The connector 40, the arms 41 and the pads 42 as a whole constitute the stretchable frame 36.

When a cellist plays the electric cello 21, the cellist pulls out the end pin 33, and draws the pads 42. Then, the arms 41 are rotated, and space the associated pads 42 from the trunk 23 as shown in FIGS. 2 and 4. The position of the pads 42 shown in FIGS. 2 and 4 are hereinbelow referred to as "stretched position". The cellist grips the handle 39, and stands the end pin 33 on the floor. The cellist sits down on a chair, and inclines the electric cello 21 toward him. The pad 38 is brought into contact with the chest of the cellist, and the electric cello 21 rests there. The cellist sandwiches the pads 42 between his knees, and keeps the electric cello 21 stable. The cellist bows the strings 32, and plays the cello.

Figure 5:
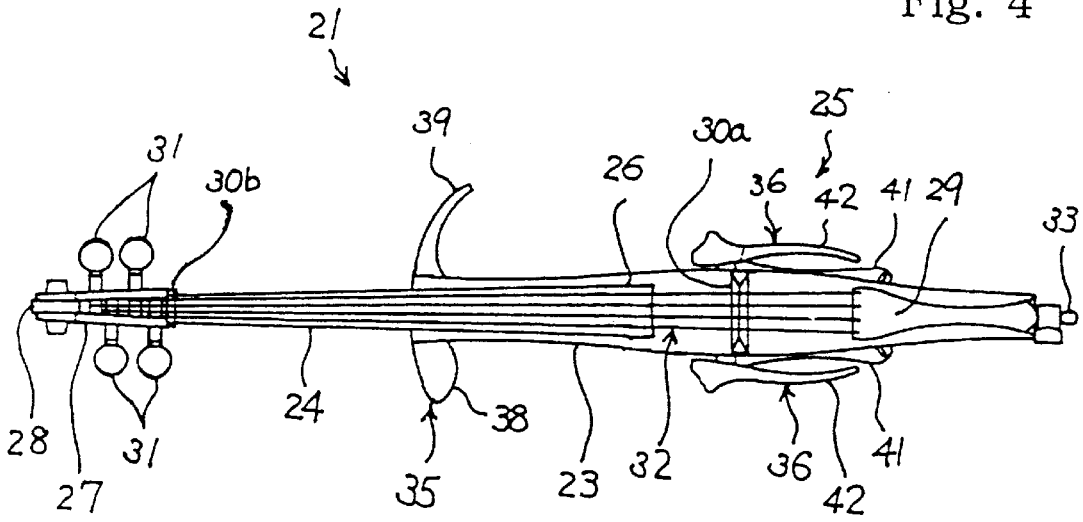
FIG. 5 is a front view showing the electric cello equipped with the stretchable frame body shrunk for carrying.
Figure 6:
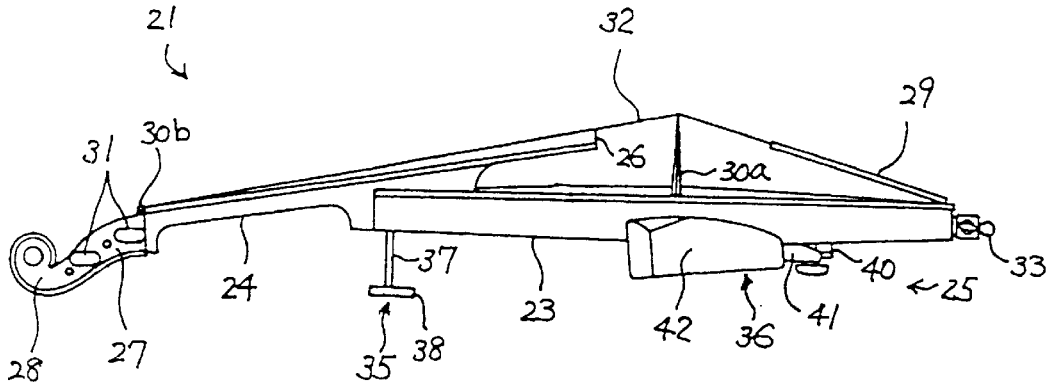
FIG. 6 is a side view showing the electric cello equipped with the stretchable frame body shrunk for carrying.
Figure 7:
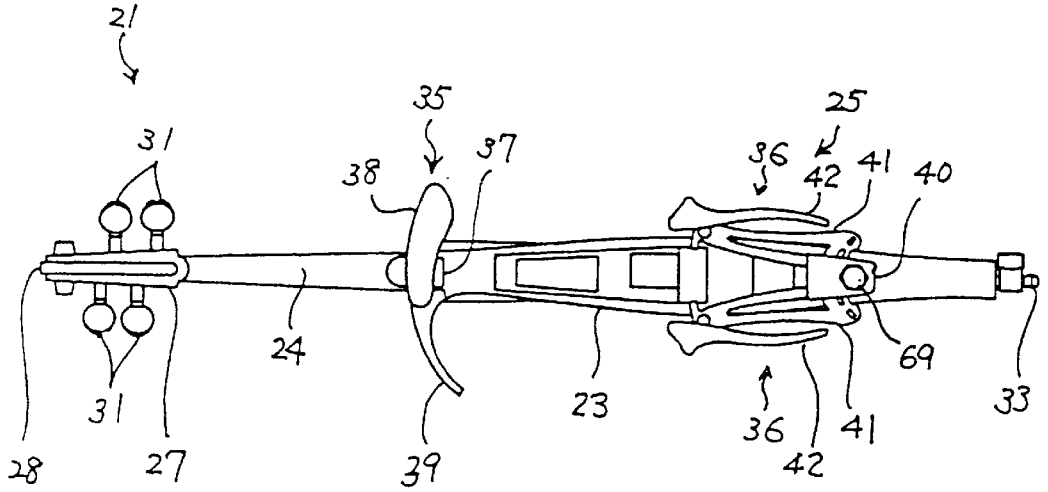
FIG. 7 is a rear view showing the electric cello equipped with the stretchable frame body shrunk for carrying.

When the cellist carries the electric cello 21 to another place, he pushes the pads 42 toward the trunk 23. Then, the arms 41 are rotated, and the pads 42 are moved to a position close to the trunk 23 as shown in FIGS. 5, 6 and 7. Thus, the stretchable frame 36 is shrunk, and the electric cello 21 is decreased in width. The cellist grips the handle 39, and carries the electric cello 21 in his arms. The position of the pads 42 shown in FIGS. 5 to 7 is hereinbelow referred to as "shrunk position".

Turning back to FIG. 2, the electronic sound generating system 22 includes a pick-up 51 embedded in the bridge 30*a*, an amplifier 52, a data processing unit 53, a tone generator 54 and a speaker system 55 and/or a headphone 56. The pick-up 51 may be implemented by a piezoelectric transducer disclosed in Japanese Patent Publication of Unexamined Application (laid-open) No. 10-133656. The piezoelectric transducer has a piezoelectric plate sandwiched between electrodes. The pick-up converts vibrations of the strings 32 to an analog electric signal, and supplies the analog electric signal to the amplifier 52. The amplifier 52 increases the magnitude of the analog electric signal, and the amplified analog signal is supplied to the data processing unit 53. The data processing unit 53 determines the pitches of electronic tones to be generated from the speaker system and/or headphone 55/56 through a digital signal processing, and instructs the tone generator 54 to produce an audio signal representative of the electronic tones. The tone generator 54 gives an envelope representative of the timbre of acoustic cello tones to oscillating signals, and imparts reverberation. The tone generator 54 supplies the audio signal to the speaker system 55 and/or the headphone 56, and the speaker system 55 and/or the headphone 56 generates the electronic tones from the audio signal. The electronic sound generating system 22 may be connectable to another kind of electric musical instrument or an audio system for an ensemble.

Figure 8:
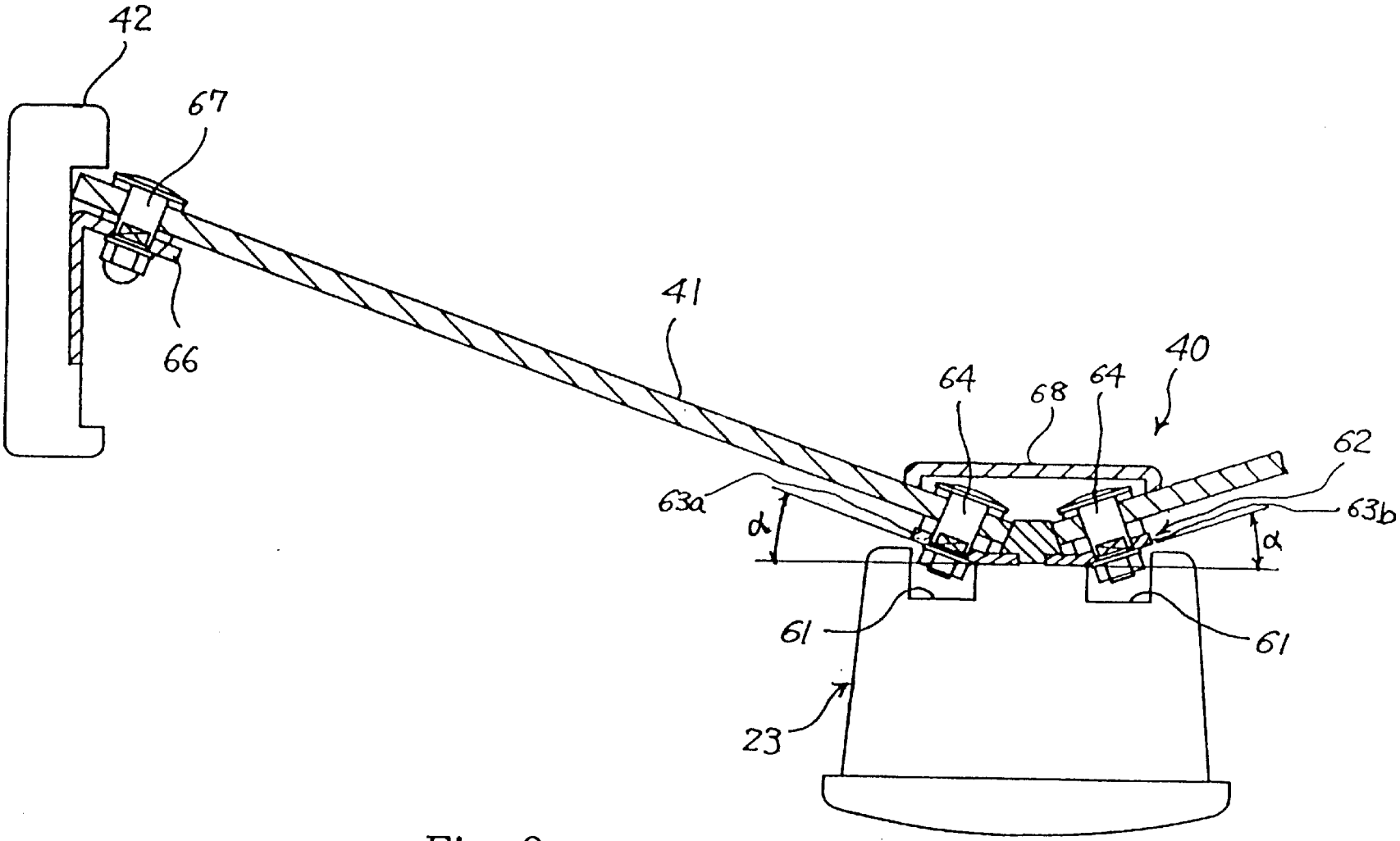
FIG. 8 is a cross sectional view showing a connector provided between the trunk and the stretchable frame body.

FIG. 8 shows the inside of the connector 40. Recesses 61 are formed in the trunk 23, and are open to the back surface. The connector 40 includes a base plate 62. The base plate 62 has a central portion and side portions 63*a*/63*b* on both sides of the central portion. The central portion trunk 23 by means of bolts (not shown), and the side portions 63*a*/ 63*b* are bent at a predetermined angle $\alpha$ with respect to the central portion. Pins 64 are attached to the side portions 63*a*/ 63*b*, and are perpendicular to the side portions 63*a*/ 63*b*, respectively. The pins 64 are rotatable with respect to the side portions 63*a*/ 63*b*. The boss portions of the arms 41 are fixed to the pins 63*a*/ 63*b*, respectively, and the arms 41 are elongated in the perpendicular direction to the rotational axes of the pins 64. For this reason, the arms 41 also incline at the predetermined angle $\alpha$ with respect to the central portion. The angle $\alpha$ is determined in such a manner than the leading ends of the arms 41 are in close proximity to the back surface of the trunk 23 when the stretchable frame 36 is shrunk. In this instance, the predetermined angle $\alpha$ is 20 degrees. When the stretchable frame 36 is shrunk, the arms 41 are directed to the pegs 31, and are substantially in parallel to the trunk 23 (see FIG. 7). When a cellist stretches the frame 36, the arms 41 are rotated over 50–60 degrees with respect to the longitudinal direction as shown in FIG. 4, and keep the pads 42 at the back of the trunk 23. Thus, the orbital plane of the pads 42 is oblique to the back surface of the trunk 23, and the predetermined angle $\alpha$ makes the orbital plane oblique to the back surface of the trunk 23.

The leading ends of the arms 41 are connected to brackets 66 by means of pins 67. The pins 67 are respectively fixed to the arms 41, and the brackets 66 are rotatable around the pins 67, respectively. The brackets 66 are fixed to the inner surfaces of the pads 42.

The connector 40 is accompanied with a positioner, and the positioner keeps the arms 41 and, accordingly, the pads 42 at the stretched position or the shrunk position. The positioner includes a clamping plate 68 and a clamp bolt 69 (see FIGS. 4 and 7). When the cellist screws the clamp bolt 69 into the base plate 62, the clamp bolt 69 presses the clamping plate 68 against the boss portions of the arms 41, and fixes the arms 41 and the pads 42 at the stretched position or the shrunk position.

Lock units 70 are provided for the pads 42 and the arms 41, and fixes the arm 41 and the pad 42 at a certain angle. The lock unit 70 includes a stopper block 71, and the stopper block 71 is slidable on the inner surface of the bracket 66. A hole 72 is formed in the stopper block 71, and is elongated in a vertical direction, i.e., a direction vertical to the back surface of the trunk 23. Bolts 73 are screwed through the hole 72 into the bracket 66, and have respective heads wider than the hole 72. For this reason, the bolts 73 are loosened, then the stopper block 71 can slide on the bracket 66 as indicated by arrow 76 (see FIG. 9). When the bolts 73 are screwed into the bracket 66, the heads are pressed against the stopper block 71, and fixes the stopper block 71 at the relative position to the bracket 66. The stopper block 71 has a projection 74, and the projection 74 and the pad 42 form a gap slightly wider than the projection 75 of the arm 41.

Figure 9:
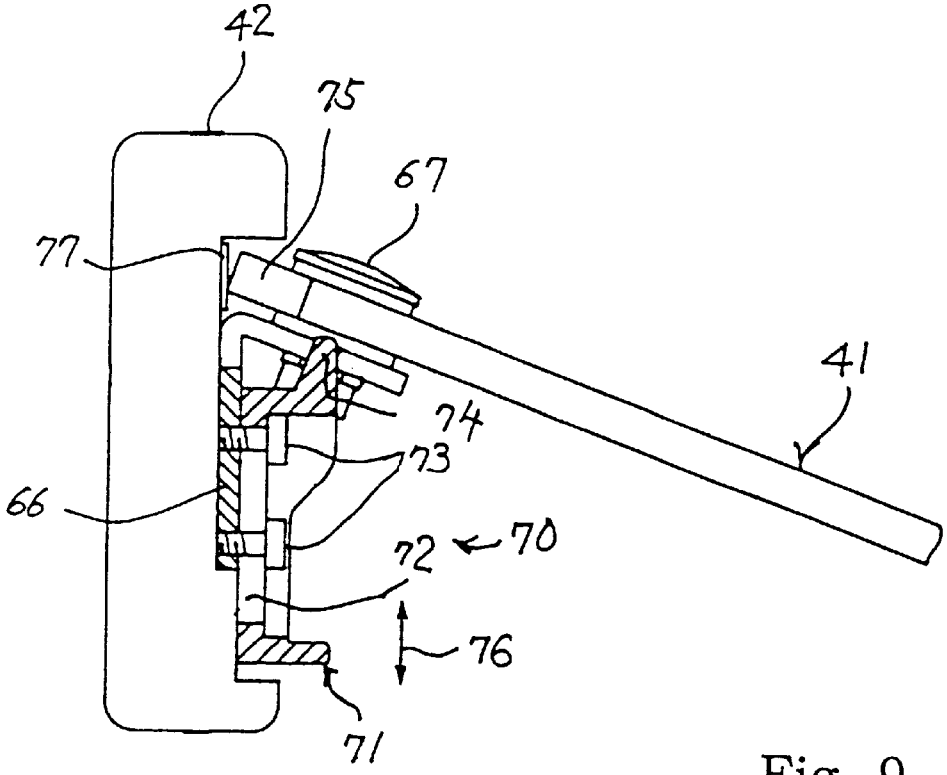
FIG. 9 is a cross sectional view showing an arm and a pad in unlocked state.
Figure 10:
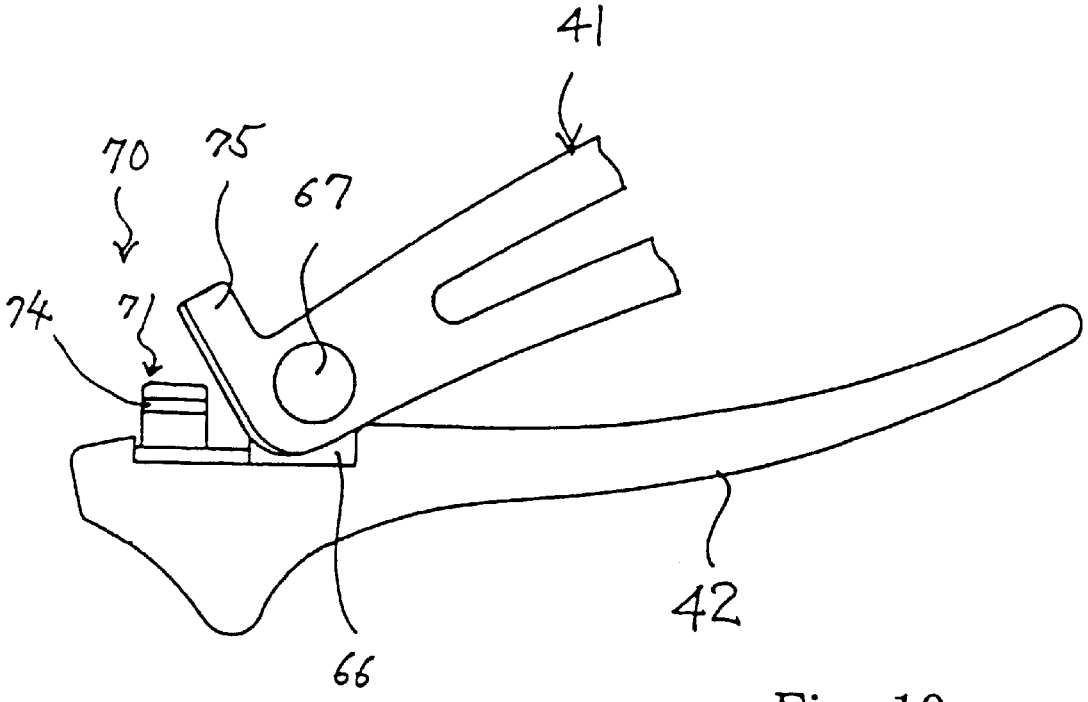
FIG. 10 is a rear view showing the arm and the pad in the unlocked state.
Figure 11:
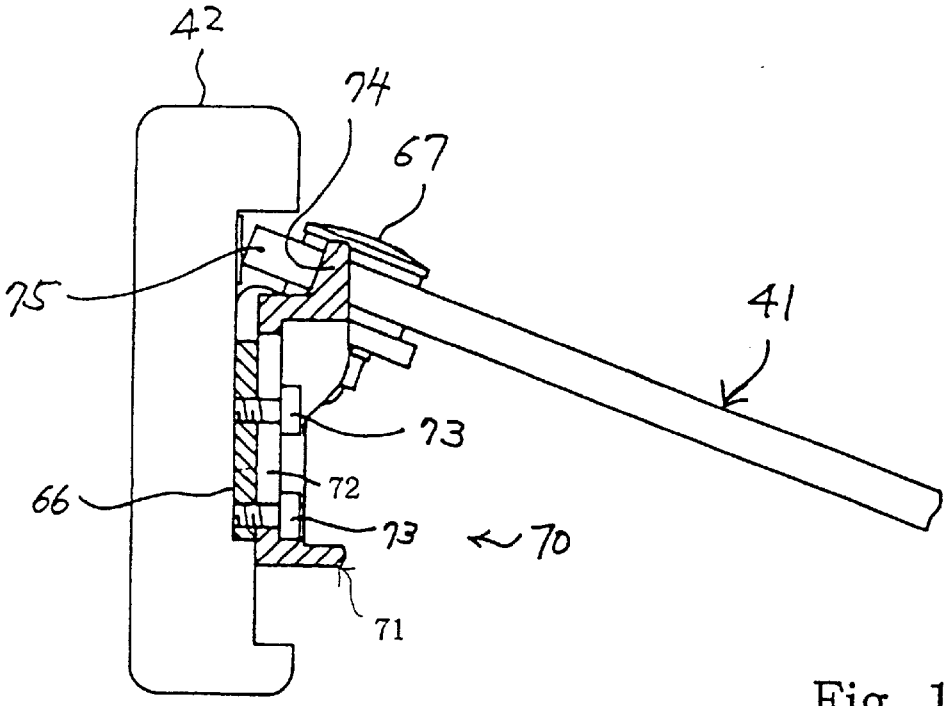
FIG. 11 is a cross sectional view showing the arm and the pad in locked state.

When the stretchable frame 36 is in the shrunk position, the stopper block 71 is in the lowest position (see FIG. 9), and the projection 75 is out of the gap between the pad 42 and the projection 74 (see FIGS. 9 and 10). The arm 41 is rotatable around the pin 64. If a cellist pulls the pad 42, the arm 41 is rotated together with the pad 42, and the stretchable frame 36 is moved toward the stretched position.

Figure 12:
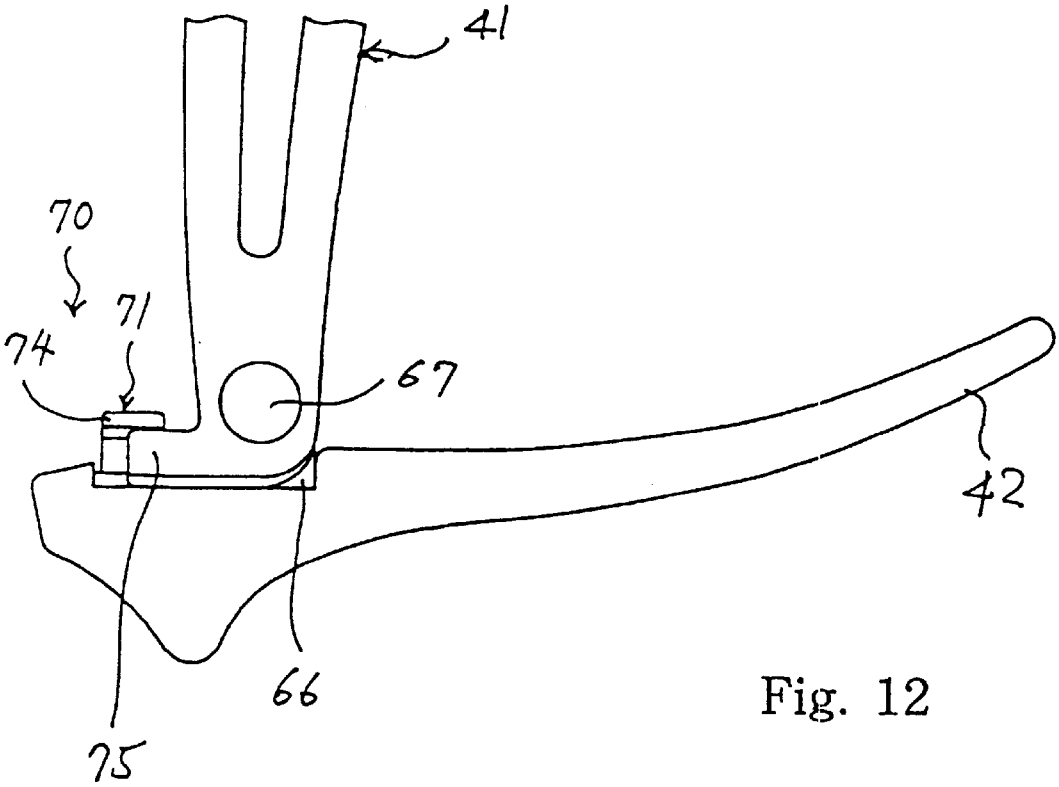
FIG. 12 is a rear view showing the arm and the pad in the locked state.

When the frame 36 reaches the stretched position, the arm 41 is substantially perpendicular to the pad 42 (see FIG. 12), and the pads 42 are arranged in such a manner as to decrease the gap therebetween toward the peg box 27 (see FIG. 4). Then, the cellist loosens the bolts 73, and upwardly moves the stopper block 71. The projection 74 is engaged with the projection 75, and the projection 75 is inserted into the gap between the inner surface of the pad 42 and the projection 74. The cellist screws the bolts 73 into the bracket 66. Then, the projection 74 presses the projection 75 against a plate 77 attached to the inner surface of the pad 42, and the bracket 66 and the pad 42 are fixed to the arm 41. Thus, the positioner and the lock units 70 fixes the stretchable frame 36 at the stretched position, and allows the cellist to hold the electric cello 21 between the knees.

In the above-described embodiment, the trunk 23 and the stretchable frame body 25 as a whole constitute a frame body.

As will be appreciated from the foregoing description, the frame body 25 has the stretchable frame 36, and the stretchable frame 36 enhances the portability of the electric cello 21. The stretchable frame 36 is changed between the stretched position and the shrunk position through the simple mechanism. The cellist is expected to loose the bolts 69 and 73 and screw them into the base plate 62 and the bracket 66, again. Thus, any complicated work is not required for the stretchable frame 36.

The orbital plane is oblique to the back surface of the trunk 23, and the arms 41 and the pads 42 are retracted to the shrunk position in close proximity to the trunk 23. As a result, the stretchable frame 36 in the shrunk position makes the electric cello 21 compact, and the cellist easily carries the electric cello 21 in his arm.

Finally, the outer side surfaces of the pads 42 are similar to the corresponding side surfaces of the body of the acoustic cello, and allows the cellist to hold the electric cello 21 between the knees as usual.

Although a particular embodiment of the present invention has been shown and described, it will be apparent to those skilled in the art that various changes and modifications may be made without departing from the spirit and scope of the present invention.

For example, a stretchable frame body may be applied to another kind of electric bowed stringed musical instrument corresponding to another member of the violin family. The strings 32 are not limited to four. Moreover, the present invention is applicable to another kind of stringed musical instrument such as, for example, a plucked string musical instrument.

What is claimed is:

1. An electric stringed musical instrument comprising a frame body including a trunk providing a center line thereof extending in a longitudinal direction and a stretchable frame changed between a shrunk position in close proximity to said trunk and a stretched position spaced from said trunk, said stretchable frame at said shrunk position being spaced from said stretchable frame at said stretched position in a direction of a thickness of said frame body and a direction of a width of said frame body, at least one string stretched over said frame body along said center line, and a sound generating system converting vibrations of said at least one string to an electric sound.

2. The electric stringed musical instrument as set forth in claim 1, in which said stretchable frame at said stretched position makes said frame body as thick as an acoustic stringed musical instrument.

3. The electric stringed musical instrument as set forth in claim 2, in which said stretchable frame has a pair of arms rotatably supported by said trunk and pads respectively connected to leading end portions of the arms of said pair so as to be changed between said shrunk position and said stretched position depending upon an angle between said arms and said center line.

4. The electric stringed musical instrument as set forth in claim 3, in which said arms are rotated on an orbital plane oblique to said center line, and said pads are spaced from said center line by a first gap measured in a direction perpendicular to said center line at said stretched position and a second gap measured in said direction at said shrunk position, and said first gap is greater than said second gap.

5. The electric stringed musical instrument as set forth in claim 3, in which said pads has respective outer surfaces shaped as similar to corresponding surface portions of a body of an acoustic stringed musical instrument where a player holds.

6. A cello comprising a frame body including a stretchable frame changed between a shrunk position in proximity to a center line thereof and a stretched position spread from said center line, at least one string stretched over said frame body a sound generating system converting vibrations of said at least one string to an electric sound, wherein said frame body further includes a trunk providing said center line so that said stretchable frame is in close proximity to said trunk in said shrunk position, said stretchable frame has a pair of arms rotatable supported by said trunk and pads respectively connected to leading end portions of the arms of said pair so as to be changed between said shrunk position and said stretched position depending upon an angle between said arms and said center line, in which said pads has respective outer surfaces shaped similar to corresponding surface portions of a body of an acoustic stringed musical instrument where a player holds, said pair of arms spaced from said outer surfaces of said pads at said stretched position by a distance equal to a distance between said corresponding surface portions sandwiched between knees of said player.

7. The electric stringed musical instrument as set forth in claim 6, in which said arms are rotated on an orbital plane oblique to said center line, and said pads are spaced from said center line by a first gap measured in a direction perpendicular to said center line at said stretched position and a second gap measured in said direction at said shrunk position, and said first gap is greater than said second gap.

8. The electric stringed musical instrument as set forth in claim 7, in which said frame body further includes a resting member attached to a back surface of said trunk and closer to one end of said trunk than said stretchable frame, and said resting member is held in contact with a chest of said player during a performance.

9. The electric stringed musical instrument as set forth in claim 7, further comprising a positioner associated with said pair of arms so as to fix said pair of arms to said trunk at said stretched position, and lock units associated with said pads so as to fix said pads to said arms at said stretched position.

10. The electric stringed musical instrument as set forth in claim 8, further comprising a neck projecting from said one end of said trunk, a finger board attached to a surface of said neck, a peg box attached to a leading end portion of said neck, a first bridge upright from an intermediate portion of said trunk and spacing said at least one string from said trunk, a second bridge attached to the finger board at a close position to said peg box, a tail piece attached to the other end portion of said trunk and anchoring said at least one string, at least one peg rotatably supported by said peg box and winging said at least one string so as to stretch said at least one string over said frame body, and a pick-up embedded in a leading end of said first bridge so as to convert said vibrations of said at least one string to an electric signal.

* * * * *